United States Patent [19]

Scelba et al.

[11] Patent Number: 4,646,547

[45] Date of Patent: Mar. 3, 1987

[54] DEAD BOLT COMBINATION LOCK

[75] Inventors: Stephen S. Scelba, Clifton; Richard Molnar, Elmwood Park, both of N.J.

[73] Assignee: Presto Lock, Inc., Garfield, N.J.

[21] Appl. No.: 608,819

[22] Filed: May 10, 1984

[51] Int. Cl.[4] ..... E05B 37/02

[52] U.S. Cl. ..... 70/312; 70/417

[58] Field of Search ..... 70/69–76, 70/312, 417, DIG. 52, DIG. 53, DIG. 54, DIG. 55

[56] References Cited

U.S. PATENT DOCUMENTS

| | | | |
|---|---|---|---|
| 761,843 | 6/1904 | Lyon . | |
| 802,062 | 10/1905 | Vieweg . | |
| 1,136,357 | 4/1915 | Newman | 70/312 |
| 1,325,641 | 12/1919 | Kish | 70/312 |
| 1,446,589 | 2/1923 | Shaw . | |
| 1,593,684 | 7/1926 | Anakin . | |
| 1,629,239 | 5/1927 | Thomas | 70/312 |
| 1,979,893 | 11/1934 | Lyons | 70/417 |
| 3,416,338 | 12/1968 | Gehrie | 70/312 |
| 3,527,070 | 9/1970 | Sato | 70/133 |
| 3,667,263 | 6/1972 | Rogers | 70/312 |
| 3,952,561 | 4/1976 | Bako | 70/70 |
| 4,123,923 | 11/1978 | Bako | 70/312 |
| 4,290,286 | 9/1981 | Rae | 70/285 |
| 4,389,863 | 6/1983 | Bako | 70/312 |
| 4,487,043 | 12/1984 | Milles | 70/312 |

FOREIGN PATENT DOCUMENTS

| | | | |
|---|---|---|---|
| 690247 | 4/1953 | United Kingdom | 70/417 |

*Primary Examiner*—Robert L. Wolfe

*Attorney, Agent, or Firm*—Shapiro and Shapiro

[57] ABSTRACT

Dead bolt combination lock having an inexpensive lock mechanism, of a type known in the luggage industry, that cooperates with a one-piece bolt. The bolt is supported for reciprocative movement on internal shoulders of a housing and forms a detent device with a resilient arm of a back cover of the housing, so that the bolt is releasably held in its locked and unlocked positions. The bolt is locked in one of those positions when the combination lock is off-combination. The configuration of the bolt resists bending, and a projecting portion of the bolt contains a case-hardened pin that can rotate to resist sawing through the bolt.

7 Claims, 7 Drawing Figures

DEAD BOLT COMBINATION LOCK

BACKGROUND OF THE INVENTION

This invention relates to dead bolt combination locks useful, for example, in controlling the locking of a door.

For a number of years, inexpensive combination locks have been widely used in the luggage industry for controlling the locking of luggage cases. Some of these combination locks have a dead bolt action that might be considered appropriate to applications outside of the luggage industry, such as controlling the locking of cabinet doors, sliding patio doors, and other types of doors commonly found in residences and elsewhere. However, the security requirements of these applications tend to be more severe than in the luggage industry. Providing the required security while maintaining the cost advantage of the locks has been a problem not easily solved.

BRIEF DESCRIPTION OF THE INVENTION

The present invention employs a lock mechanism of a type well known in the luggage industry to provide a dead bolt combination lock of much wider applicability, and to provide greater security than is usually required for luggage applications while retaining the simplicity and cost advantages of combination locks employed in the luggage industry.

In one of its broader aspects, a dead bolt combination lock in accordance with the invention comprises a housing having a front wall, a pair of side walls, and a pair of end walls. A combination lock mechanism is mounted in the housing adjacent to the front wall. The front wall has a plurality of slots therein, and the lock mechanism includes a plurality of dials with peripheral portions exposed through the slots, respectively. A bolt is supported in the housing for reciprocative movement along the length of the housing between unlocked and locked positions. The bolt has a portion adapted to project outwardly through an opening in an end wall of the housing when the bolt is in its locked position. A manual actuator is supported for movement along the length of the housing, has a portion that extends into the housing through an elongated slot in the front wall of the housing, and is fixed to the bolt for manually moving the bolt between its unlocked and locked positions. The housing has a rear wall that supports detent means thereon extending into the housing to engage the bolt, and the bolt has cooperable means for releasably holding the bolt in its unlocked and locked positions. The lock mechanism has locking means controlled by the dials for preventing the bolt from moving from its locked position until the dials are set to a predetermined unlocking combination.

DETAILED DESCRIPTION OF THE PREFERRED EMBODIMENT

Figure 1:
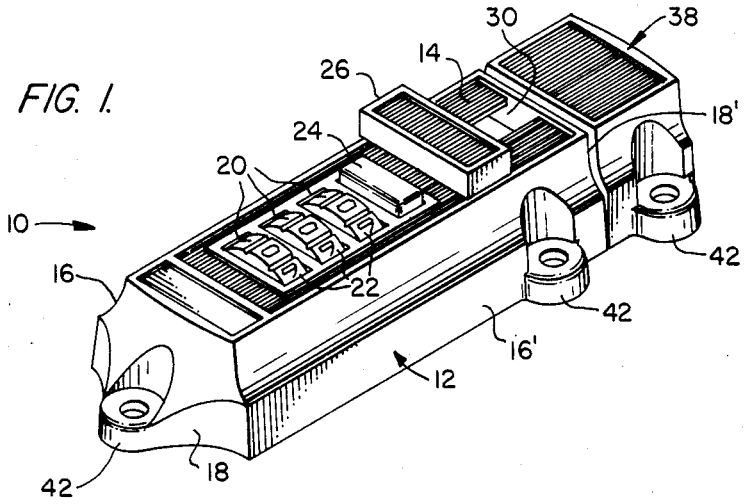
FIG. 1 is a perspective view illustrating the external appearance of a dead bolt combination lock in accordance with the invention.
Figure 2:
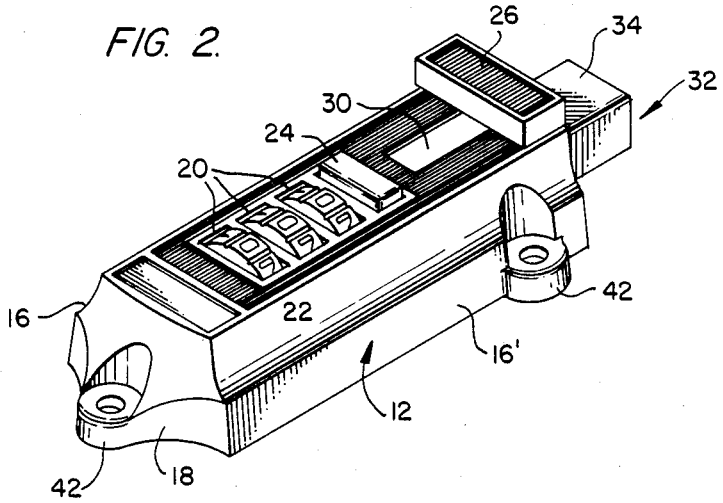
FIG. 2 is a similar view showing the bolt extended from the lock housing to a locked position, a bolt-receiving receptacle shown in FIG. 1 being omitted from FIG. 2 so that the bolt may be visible.
Figure 3:
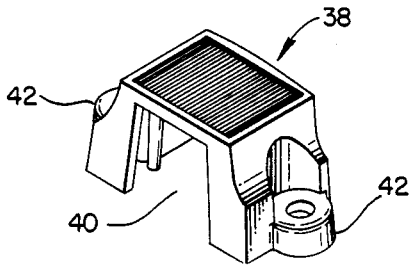
FIG. 3 is a perspective view of the bolt-receiving receptacle shown in FIG. 1.

Referring first to FIGS. 1–3 of the drawings, a dead bolt combination lock 10 in accordance with the invention comprises an elongated housing 12 having a front wall 14, a pair of side walls 16, 16' and a pair of end walls 18, 18'. The front wall has a plurality of slots 20 through which peripheral portion of indicia-bearing combination dials 22 are exposed. The lock may have a shift member 24 which may be actuated after the dials have been set to a predetermined unlocking combination and that permits the dials to be turned relative to other parts of the lock mechanism (to be described) so that the user may select a new unlocking combination.

Figure 4:
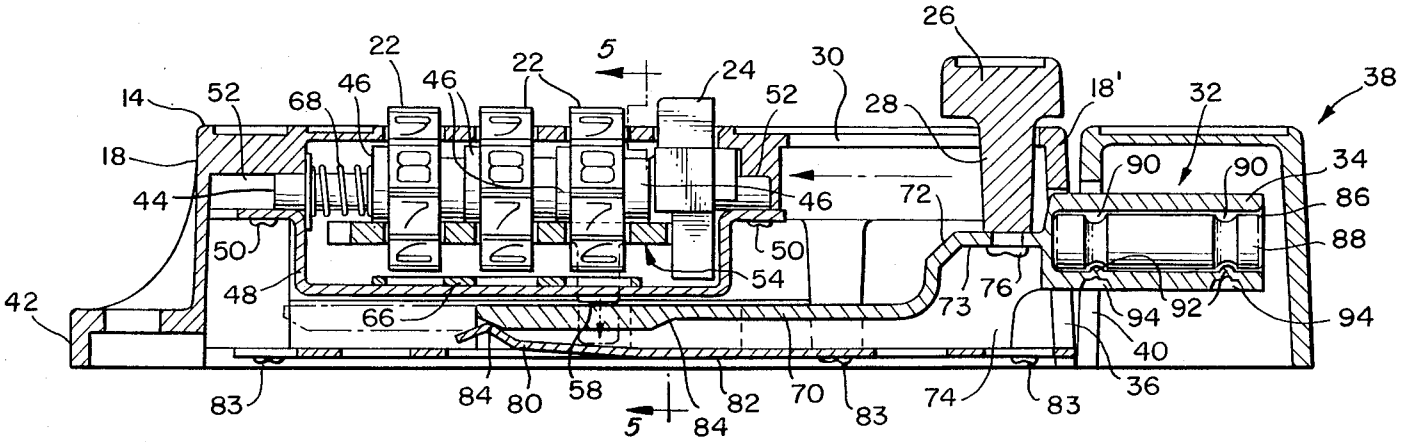
FIG. 4 is a longitudinal sectional view of the invention.

A manual actuator 26 is supported for movement along the length of front wall 14 and has a portion 28 (see FIG. 4) that extends through a longitudinal slot 30 in wall 14 for connection to a bolt 32. As shown in FIGS. 2 and 4, the bolt has a block portion 34 adapted to project through an opening 36 in end wall 18' when the bolt is moved by the manual actuator to the locked position shown in FIGS. 2 and 4. When the manual actuator 26 is in the position shown in FIG. 1, block-portion 34 of the bolt is retracted into housing 12, and the bolt is in the unlocked position. A bolt-receiving receptacle 38, which may be shaped like an extension of housing 12, but spaced therefrom adjacent to end wall 18', receives portion 34 of the bolt through an opening 40 of the receptacle (see FIGS. 3 and 4).

Housing 12 and receptacle 38 may be formed with integral apertured bosses 42 to permit the housing and the receptacle to be attached to underlying supports. In the form shown, bosses 42 are provided at opposite sides of receptacle 38 (see FIG. 3), at opposite sides of housing 12 (only one of the side bosses being visible in FIGS. 1 and 2), and at end wall 18 of the housing. Housing 12 may be mounted on a door, for example, and receptacle 38 on a jamb or frame member adjacent to the door. It is apparent that when the bolt 32 is in its locked position (FIGS. 2 and 4), the member supporting the housing 12 will be unable to move, relative to the member supporting receptacle 38, in any direction that would cause the bolt to engage an edge of opening 40 of the receptacle. Instead of a receptacle of the type shown, a simple bent plate, loop, or recess in a frame member may be employed to receive the bolt.

Figure 6:
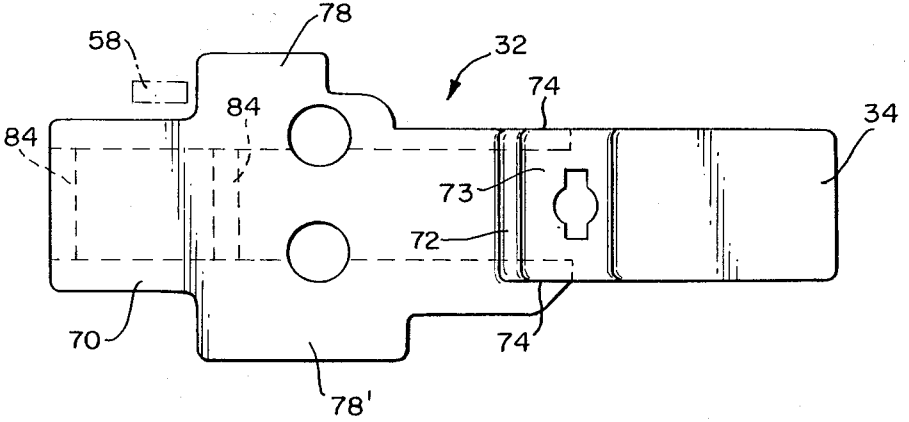
FIG. 6 is a plan view illustrating a preferred form of bolt employed in the invention and indicating, in phantom lines, blocking means for locking the bolt.
Figure 5:
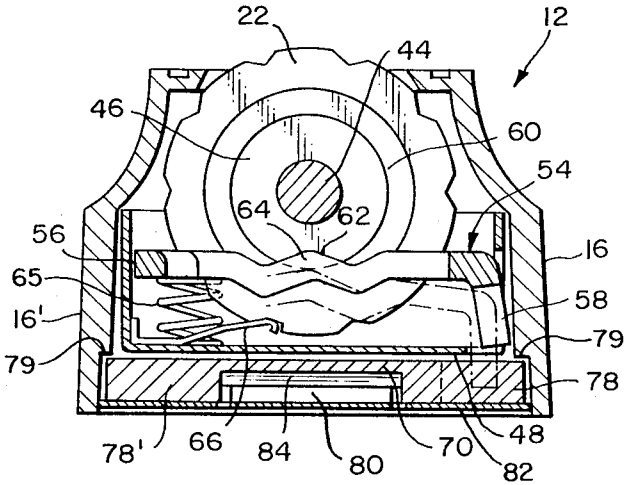
FIG. 5 is a transverse sectional view taken along line 5—5 of FIG. 4.

Turning now to FIGS. 4–6, an important aspect of the invention is the utilization of a simple combination lock mechanism of a type well known in the luggage industry. The lock mechanism is preferably of the type disclosed in U.S. Pat. No. 4,389,863, issued June 28, 1983, and assigned to the same assignee as the present invention, the disclosure of which is incorporated herein by reference. In addition to the dials 22, the lock mechanism comprises a shaft 44 supporting a plurality of locking sleeves 46 for rotation thereon. A frame 48, which may be attached to bosses formed internally of wall 14 by mean of rivets 50 integral with the bosses, holds shaft 44 in position in recesses 52 formed in the underside of wall 14. A locking member 54 (FIG. 5) is supported pivotally on the frame along one edge 56 and is formed integrally with blocking means 58 at the opposite edge for cooperation with the bolt 32 in a manner to be described.

Each locking sleeve 46 may have a circular flange 60 in which a V-shaped notch 62 is formed for receiving a corresponding ridge 64 of locking member 54 when all of the sleeves have a predetermined rotational position, shown in FIG. 5. Locking member 54 is biased toward the sleeves by springs 65. When any locking sleeve 46 is turned away from the position illustrated in FIG. 5, locking member 54 is cammed to the phantom line position shown in FIG. 5. Each locking sleeve is normally coupled to its dial by external teeth on the hub of the sleeve that engage internal teeth in the central bore of the dial, so that each sleeve is compelled to rotate with its dial.

A dial spring unit 66 having resilient arms engaging peripheral notches of the dials provides indexing of the dials as they are rotated. When the dials have been set to display the unlocking combination of the lock at the central portion of the slots 20 as shown in FIGS. 1 and 2 (combination 0-0-0 in the illustration), locking member 54 assumes the position shown in full lines in FIG. 5, so that the dead bolt can be moved to its unlocked position, as will be described hereinafter, and, if desired, the unlocking combination can be changed by manipulating the shift member 24 so as to cause the locking sleeves 46 to move along the axis of shaft 44, against the bias of a spring 68, to uncouple the sleeves from the dials and permit the dials to be turned relative to the sleeves to select a new combination. Further details of the combination lock mechanism and its operation are found in the aforementioned patent.

As shown in FIGS. 4 and 6, in addition to portion 34 the bolt 32 comprises, integrally, a plate 70 and a transition 72. Plate 70 lies substantially in a single plane, and portion 34 is offset from the plane of the plate as shown in FIG. 4. The transition 72 has a front wall 73 and a pair of spaced side walls 74 that merge with plate 70 and with the block-portion 34 of the bolt. Side walls 74 are perpendicular to plate 70. This provides great resistance to bending of portion 34 relative to plate 70 and avoids the need for a heavy massive bolt. As is apparent in FIG. 4, portion 28 of manual actuator 26 may be attached to the wall 73 of the bolt by an integral rivet 76.

Figure 7:
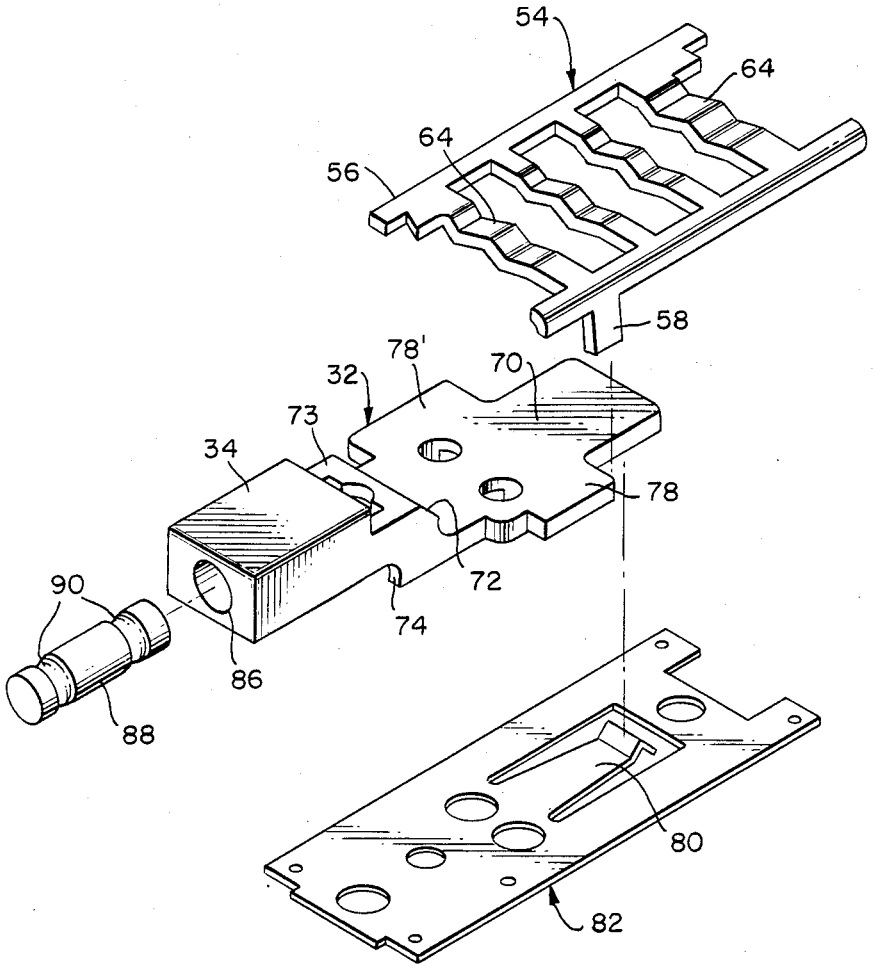
FIG. 7 is an exploded perspective view illustrating the bolt and related parts employed in providing dead bolt action.

As shown in FIGS. 5 and 6, plate 70 has laterally extending wing members 78 and 78' along opposite edges of the bolt for supporting the bolt on longitudinally extending shoulders 79 formed integrally on the inner surfaces of the side walls 16 and 16' of the housing 12. The bolt is releasably held in its locked and unlocked position by a detent device comprising a resilient arm 80 that may be struck inwardly from a rear wall or back cover plate 82 of housing 12 (see FIG. 7). The cover plate, which may be punched out of sheet metal, is attached to the housing by integral rivets 83 on bosses integral with the side walls of the housing. Arm 80 is free at one end to engage the plate 70, as shown in FIG. 4, and is cantilevered from the main body of cover plate 82 at the other end of the arm. The free end of the arm may have a V-configuration as shown for cooperation with a pair of ramps 84 on the rear side of the bolt. As shown in FIGS. 5 and 6, the central part of plate 70 may be recessed, and ramps 84 may be formed at the ends of a shallow plateau in the recess. Engagement of spring arm 80 and ramps 84 is effective to provide a detenting action for the bolt in its locked and unlocked positions.

When the bolt is in the locked position illustrated in FIG. 4, blocking means 58 can be moved (downwardly in FIG. 4) so as to be inserted behind wing member 78 (see FIG. 6). This will be the case if the lock is off-combination, and the manual actuator 26 will be unable to move the bolt from the locked position illustrated in FIG. 4 in solid lines to the unlocked position indicated in phantom lines. However, from the foregoing description of the operation of the lock mechanism, it will be apparent that when the lock is on-combination, blocking means 58 will be withdrawn from the path of wing member 78, and the bolt will be free to move to its unlocked position. If the lock is placed off-combination after the bolt has been moved to its unlocked position, blocking means 58 will be inserted into the path of wing member 78, but at the opposite end of the wing member, preventing the bolt from being moved to its locked position. Retaining the bolt in its unlocked position is sometimes desirable.

To provide the desired strength, many of the parts of the dead bolt combination lock of the invention are preferably die cast parts. This may include, for example, housing 12, receptacle 38, and bolt 32. To provide additional security, the block-portion 34 of the bolt preferably has a longitudinal cylindrical bore 86 in which a cylindrical case-hardened steel pin 88 is inserted. The pin has a pair of circumferential grooves 90 which receive dimples 92 of the bolt to retain the pin against axial movement in bore 86 but to permit the pin to rotate, so that if an attempt is made to saw through the block-portion 34, the pin will rotate and defeat the attempt. The dimples 92 are preferably formed by providing recesses 94 in the bolt which are easily distorted inwardly by a punch to stake the pin 88 in the desired position. Thus the pin is retained simply and inexpensively.

From the foregoing description, it is apparent that the invention provides a dead bolt combination lock that is simple, relatively inexpensive, and yet highly effective. The construction of the invention permits the utilization of a combination lock mechanism that is well known in the luggage industry and that requires little or no modification for use in the invention. Bolt 32 of the invention is a simple, single piece that is easily supported for reciprocative movement and for cooperation with the combination lock mechanism, and yet that provides the desired strength. The shape of the bolt itself provides part of a detent device for releasably retaining the bolt in its locked and unlocked positions. To complete the detent device, all that is required is an inexpensive modification of a back cover of the housing.

While a preferred embodiment of the invention has been shown and described, it will be apparent to those skilled in the art that changes can be made in this embodiment without departing from the principles and spirit of the invention, the scope of which is defined in the appended claims.

What is claimed is:

1. A dead bolt combination lock comprising an elongated housing having a front wall, a pair of side walls, and a pair of end walls, a combination lock mechanism mounted in said housing adjacent to said front wall, said front wall having a plurality of slots therein and said lock mechanism including a plurality of dials with peripheral portions exposed through said slots, respectively, a bolt supported in said housing for reciprocative movement along the length of said housing between unlocked and locked positions, one of the end walls of said housing having an opening therethrough and the bolt having a block-portion adapted to project outwardly of said housing through said opening when the bolt is in its locked position, a manual actuator supported for movement along the length of said housing and having a portion extending into said housing through a slot in said front wall of the housing and fixed to the bolt for manually moving the bolt between its unlocked and locked positions, said housing having a rear wall with detent means thereon extending into said housing to engage said bolt, said bolt having means cooperable with said detent means for releasably holding said bolt in its unlocked and locked positions, said lock mechanism having locking means controlled by said dials for preventing said bolt from moving from its locked position until said dials are set to a predetermined unlocking combination.

2. A dead bolt combination lock in accordance with claim 1, wherein said bolt comprises, integrally, in addition to said block-portion, a plate that is offset from the block-portion in the direction of the rear wall of the housing and that is connected to the block-portion by a transition, said cooperable means of said bolt comprising a pair of ramps spaced along the length of said plate.

3. A dead bolt combination lock in accordance with claim 2, wherein the block-portion of the bolt is adapted to enter a cooperable receptacle and wherein said block-portion has a longitudinal cylindrical bore containing a cylindrical hardened pin adapted to rotate about the axis of the bore, the pin having at least one circumferential groove, and the block having a dimple pressed into said groove to retain the pin against longitudinal movement in the bore but to permit the pin to rotate therein.

4. A dead bolt combination lock in accordance with claim 2, wherein said transition comprises a pair of spaced side walls extending substantially perpendicularly from said plate and providing substantial resistance to bending of said block-portion relative to said plate.

5. A dead bolt combination lock in accordance with claim 4, wherein said side walls of said housing have internal longitudinal shoulders on which said plate is supported for longitudinal movement.

6. A dead bolt combination lock in accordance with claim 5, wherein said lock mechanism includes a frame attached to said front wall of said housing for positioning, adjacent to said front wall, a shaft rotationally supporting said dials, said locking means comprising a plurality of locking sleeves rotatable with said dials, respectively, and a pivoting locking member supported for movement toward and away from said sleeves, said sleeves having means for moving said locking member away therefrom until all of said sleeves have a predetermined rotational position corresponding to the unlocking combination of the lock, said locking member having means for blocking the movement of said plate when said bolt is in its locked position and said locking member is away from said sleeves.

7. A dead bolt combination lock in accordance with claim 1, wherein said detent means comprises a resilient arm integral with said rear wall.

* * * * *